US005544837A

United States Patent [19]

Menegatto

[11] Patent Number: 5,544,837

[45] Date of Patent: Aug. 13, 1996

[54] BRAKING ASSEMBLY FOR A REEL-HOLDER FLANGE IN TEXTILE MACHINES

[75] Inventor: Carlo Menegatto, Milan, Italy

[73] Assignee: Menegatto S.r.l., Milan, Italy

[21] Appl. No.: 363,522

[22] Filed: Dec. 23, 1994

[30] Foreign Application Priority Data

Dec. 24, 1993 [IT] Italy ..... MI93A02734

[51] Int. Cl.[6] ..... B65H 49/26; B65H 54/00; B65H 54/553; F16D 51/00

[52] U.S. Cl. ..... 242/599.3; 188/326; 188/363; 242/18; 242/129.8; 242/156

[58] Field of Search ..... 242/599.3, 129.51, 242/129.8, 156, 18 DD, 596.7; 188/335, 325, 326, 362, 363, 364

[56] References Cited

U.S. PATENT DOCUMENTS

| | | | |
|---|---|---|---|
| 1,881,240 | 10/1932 | Pentz | 188/363 X |
| 2,146,009 | 2/1939 | Chase | 188/363 |
| 2,207,421 | 7/1940 | Tirabasso | 188/335 |
| 2,311,175 | 2/1943 | Hitt | 242/18 DD |
| 2,495,074 | 1/1950 | Mossey | 188/363 |
| 2,503,615 | 4/1950 | Gooch | 188/335 X |
| 3,044,733 | 7/1962 | Ingham, Jr. | 242/18 DD |
| 3,252,666 | 5/1966 | Bagwell, Jr. | 242/18 DD |
| 3,295,637 | 1/1967 | Wells | 188/363 X |
| 4,328,928 | 5/1982 | Zang | 242/129.51 X |
| 4,347,990 | 9/1982 | Ohashi | 242/36 |
| 4,401,197 | 8/1983 | Bohla et al. . | |
| 4,848,686 | 7/1989 | Demuth et al. | 242/129.51 X |
| 4,880,174 | 11/1989 | Kawamura et al. | 242/18 DD |

FOREIGN PATENT DOCUMENTS

| | | |
|---|---|---|
| 0087376 | 8/1983 | European Pat. Off. . |
| 3011272 | 10/1980 | Germany . |
| 2939628 | 4/1981 | Germany . |
| 473049 | 7/1969 | Switzerland . |

*Primary Examiner*—Michael R. Mansen
*Attorney, Agent, or Firm*—Young & Thompson

[57] ABSTRACT

Braking assembly for a reel-holder flange in textile apparatus, comprising a fixed flange connected to the arm for supporting the reel, at least a first and a second braking shoe supported by the fixed flange, each having an external arched lateral face which defines a braking surface for a corresponding internal annular braking band of the reel-holder flange. A drive is provided for driving the braking action which comprise at least a first and a second thrust device provided between the first and second braking shoe at the facing and opposite ends of the braking shoes, with the thrust devices which act on the braking shoes in a direction circumferential to the latter to move them apart one from the other and create a displacement in diverging radial directions of the shoes towards and against the coupling band of the reel-holder flange.

11 Claims, 2 Drawing Sheets

BRAKING ASSEMBLY FOR A REEL-HOLDER FLANGE IN TEXTILE MACHINES

FIELD OF THE INVENTION

The present invention relates to a braking assembly for a reel-holder flange in textile apparatus.

BACKGROUND OF THE INVENTION

Devices for braking a reel-holder flange in rotating motion in textile apparatus have already been provided in the art. They comprise essentially a fixed flange connected to the arm supporting the reel, a first and a second braking shoe in the form of arched shells, coplanar and facing one in respect of the other, with external arched lateral faces which define a braking surface, and which are attached to said fixed flange, and means for driving the movement of said first and second braking shoe towards and against an annular band of said reel-holder flange arranged inside said braking shoes, to engage it with friction and to brake rotation of said reel-holder flange. Suitable elastic means are also provided to return, acting in opposition to said means for driving the braking action, said first and second shoe into a rest position of non-braking.

Braking devices for reel-holder flanges currently in use generally adopt braking shoes, of the type referred above, which are both restrained to said fixed flange at one of their facing or matching ends by means of a pin which allows outward rotation, driven by a suitable thrust device acting to move the shoes apart on the side opposite that of hinging.

Such a type of drive of the braking shoes is disadvantageous in that it brings into contact with the annular surface used for the braking action of said reel-holder flange only restricted portions of the external braking face of each shoe. This leads to low efficiency braking which rapidly consumes the shoes at the points in contact with the annular band of braking of the mobile flange.

Moreover said known braking devices, due to the fact that they have to attach said braking shoes one to the other and to said fixed flange and due to the fact that they often make use, to move the shoes apart, of mechanical thrust means which have a certain structural complexity, are awkward to set up and involve an excessive use of time for their assembly. Moreover in the field of textile apparatus, the need has been felt to provide braking assemblies for reel-holder flanges which are simple, inexpensive, compact and which can be actuated by means of a pressurised fluid. More particularly they have a thin section in order not to create excessive volume between the reel-holder flange and the support arm.

The object of the present invention is therefore that of providing a braking assembly for a reel-holder flange in textile apparatus which has a more effective braking action and longer-lasting life span of the parts in contact through friction compared to similar braking devices already known in the textile industry.

Another object of the present invention is that of providing a braking assembly for a reel-holder flange which, in addition to achieving the previous objects, occupies a limited volume, can be easily and rapidly prepared, involves low manufacturing costs and can be actuated by means of a pressurised fluid normally used for driving other components of the textile machine.

SUMMARY OF THE INVENTION

The previous objects are achieved with a braking assembly for a reel-holder flange comprising a fixed flange connected to an arm for supporting the reel, at least a first and a second braking shoes supported by said fixed flange in the form of arched elements arranged coplanarly, in which each of said braking shoes has lateral end face with the lateral end faces of one of said braking shoes which are parallel and opposite to the end faces of the other braking shoe, and a respective external arched lateral face which defines a braking surface, the braking assembly also comprising means for blocking rotation of said first and second braking shoes in relation to said fixed flange, means for driving the movement of said first and second shoes towards and against an annular braking band of a reel-holder flange surrounding said braking shoes to engage it with friction and to brake rotation of the same reel-holder flange, said means of driving the braking action acting in opposition to elastic return means suitable for returning said first and second shoes into a rest condition; in which said means for driving the braking action comprise at least a first and a second thrust device provided between said first and second braking shoes at the facing and opposite end faces of said braking shoes, said thrust devices acting on said braking shoes in a circumferential direction to the latter in order to move them apart one from the other and provide a displacement in diverging radial directions of said shoes towards and against said coupling band of said reel-holder flange.

Making use of a first and a second thrust device provided at the opposite lateral ends of the braking shoes and acting with a thrust effect between said braking shoes in circumferential directions in order to cause their moving apart in diverging radial directions, allows the braking shoes to be brought close to the annular contact band of the reel-holder flange, with a translatory rather than rotary motion as occurred in the prior art, so as to bring into contact with said band of the reel-holder flange practically the whole of the external curved braking face of each shoe.

This leads to more effective braking and even wear of the whole braking surface of said shoes which consequently have improved durability.

BRIEF DESCRIPTION OF DRAWINGS

Further features and advantages of the present invention will be made clearer on reading the following description relating to a preferred embodiment of the present invention, a description which has to be read with reference to the accompanying drawings, in which.

DESCRIPTION OF THE PREFERRED EMBODIMENT

Figure 1:
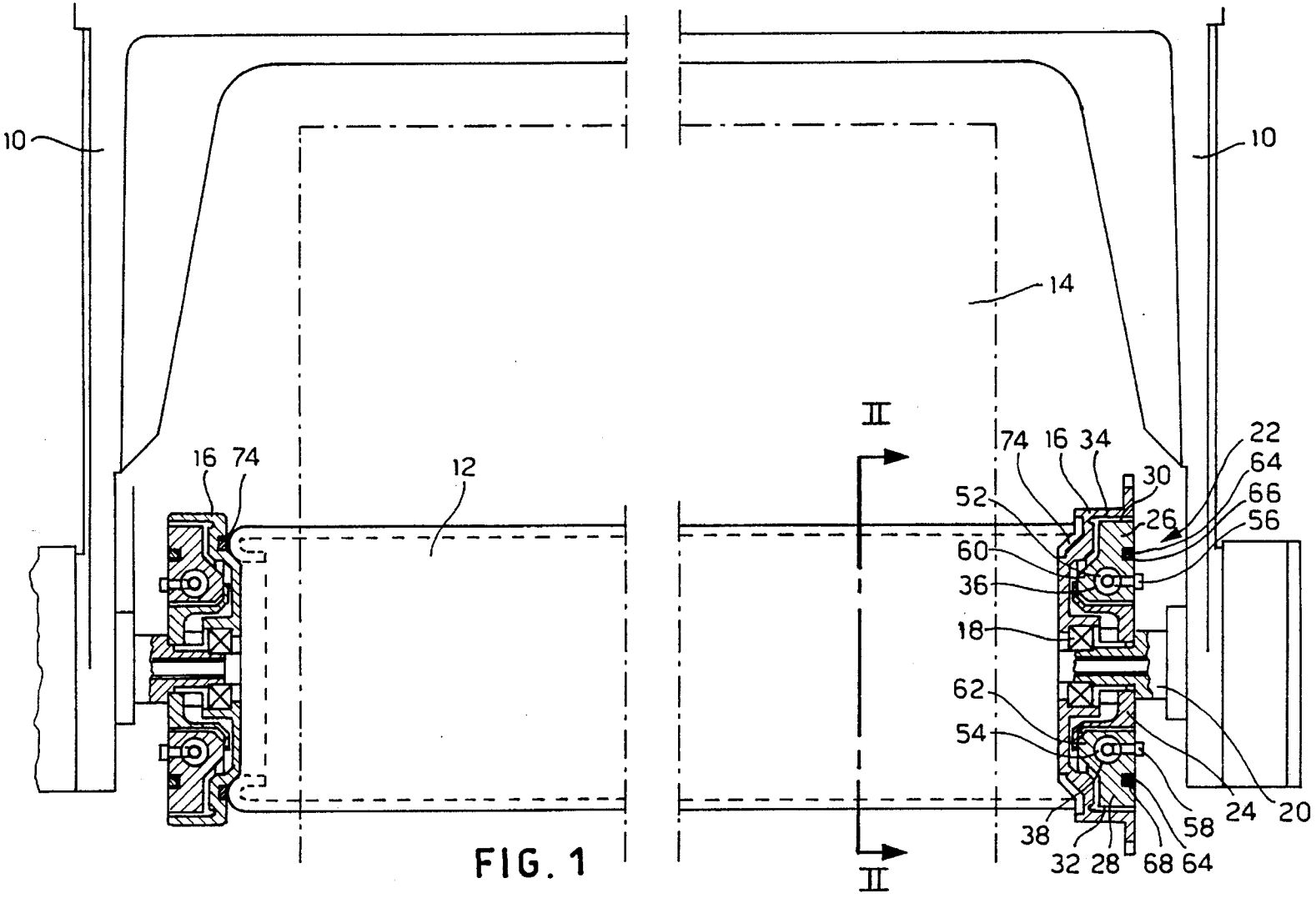
FIG. 1 represents a view from above of the assembly for supporting the reel with a section view of the details of the brakes of the reel-holder flanges according to the preferred embodiment of the present invention.

FIG. 1 shows a reel-holder arm 10 which supports a cop or reel 12 whereon a package of yarn 14 is wound by means of lateral flanges 16 freely rotating together with said cop 12.

Each flange 16 is connected, rotating freely thanks to a suitable ball bearing 18, to a pin 20 which extends from said arm 10 for supporting the reel and is braked in its rotary motion by the braking assembly 22, according to a preferred embodiment of the present invention, which comprises a fixed flange 24 attached to said pin 20 of the reel-holder arm 10, suitable for supporting the braking elements of the braking assembly.

Figure 2:
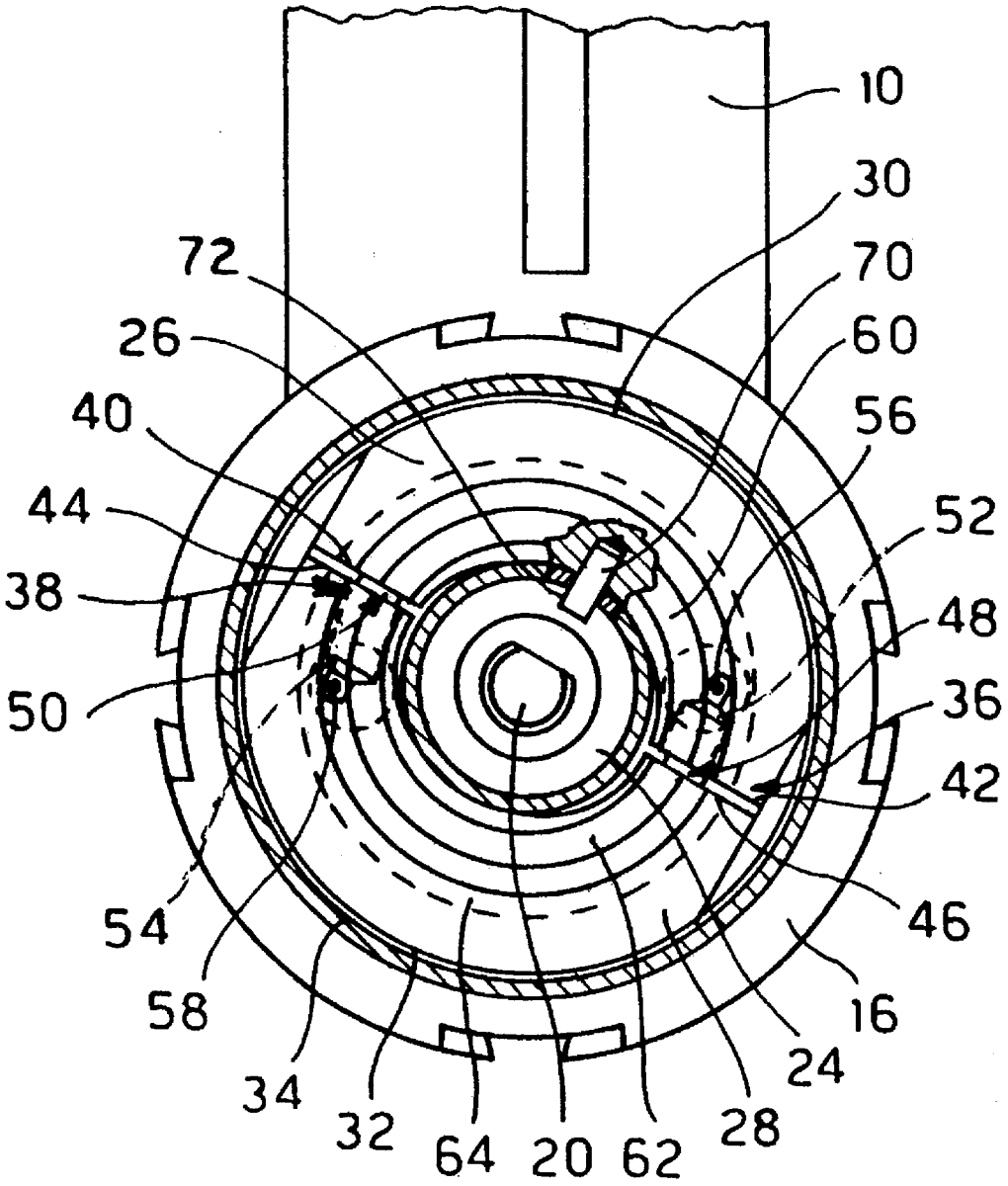
FIG. 2 is a cross-sectional view, with parts broken away, taken on the line II—II of FIG. 1.

As is made clearer also by referring to FIG. 2, the braking elements consist of a first and a second braking shoe 26, 28 in the form of semicircular shells, coplanar and opposite one to the other, and which have external curved faces 30, 32 defining a braking surface.

Said first and second braking shoes 26, 28 are pushed against an annular band 34 of said reel-holder flange 16, surrounding the braking shoes 26, 28 themselves, by means of a first and a second thrust device 36, 38 acting circumferentially to said braking shoes between respective opposite lateral end faces of said shoes 40, 42 and 44, 46 respectively of said first braking shoe and of said second braking shoe, to move the shoes apart from each other with a translatory motion in diverging radial directions.

In this way it is possible, as previously mentioned, to bring the whole external curved surface of friction of said shoes 30, 32 into contact with the annular band 34 and brake said reel-holder flange 16 efficiently and evenly.

Obviously according to the present invention it can also be foreseen to provide more than two braking shoes arranged circumferentially with thrust devices between the lateral end faces of adjacent shoes in a circumferential direction in order to cause a diverging and radial translatory movement of the shoes towards and against the braking band of the reel-holder flange.

According to the invention it is foreseen to provide these thrust devices 36, 38 as thrust devices actuated by a pressurised fluid, more particularly of the pneumatic type.

For this purpose said thrust devices 36, 38 comprise cylindrical pistons 48, 50 sliding in respective compression chambers 52, 54 in the form of cylindrical grooves provided in said braking shoes 26, 28 and having an opening at the lateral end faces to allow the free sliding of the respective piston 48, 50.

According to a further feature said pistons are provided with a length greater than the length of the respective cylindrical chambers so as to extend outside of the chamber towards and in contact with the opposite lateral end face of the other braking shoe and provide in a rest condition elements for reciprocal support between said braking shoes 26, 28 and for spacing between the opposite lateral end faces of the braking shoes.

According to the invention said compression chambers 52, 54 of the thrust pistons 48, 50 are provided one in the first braking shoe 26 and the other in the second braking shoe 28 at the respective lateral end faces 42, 44, the other lateral end faces 40, 46 of said braking shoes being provided planar and perpendicular to the direction of action of the respective piston. Nevertheless it can also be foreseen for the present invention to provide compression chambers for said thrust pistons at lateral end faces of a single braking shoe, in this case said pistons would engage against the lateral end faces free of thrust devices of the other braking shoe.

Advantageously said compression chambers 52, 54 are fed from the outside, to the rear of the piston, with a pressurised fluid by means of respective feed pipes 56, 58 provided inside said braking shoes 26, 28 and extending outside of the latter on the rear side in order to be easily connected to the pipes for feeding the pressurised fluid.

Said pipes for feeding the pressurised fluid 56, 58 lead into respective compression chambers 52, 54 to the rear of the transverse back wall of the latter.

Each of said compression chambers 52, 54 extends from the respective lateral end face for a certain rectilinear section inside the braking shoe at an annular portion radially internal to said shoe.

Each shoe 26, 28 has at said internal annular portion an enlarged section 60, 62 suitable for containing a respective compression chamber 52, 54 of convenient size for the thrust of the piston.

According to the invention elastic return means are provided, acting against said thrust pistons 48, 50 to return the braking shoes 26, 28 into their withdrawn rest position.

Said elastic return means are in the form of a continuous annular elastic element 64 which winds circumferentially around said braking shoes and exerts a radial action which tends to recompose them one close to the other.

Said annular elastic element 64 is conveniently housed in semicircular splines 66, 68 provided conveniently on the rear side of each braking shoe 26, 28 in a radially more outer position in relation to the position of said thrust devices 36, 38.

In order to prevent rotation of said braking shoes 26, 28 in relation to said fixed support flange 24 which allows at the same time easy radial movement of said shoes, means for blocking rotation of said shoes has been provided consisting, as is fully clear from FIG. 2, of a plug 70, attached to said first braking shoe 26, and which extends radially inside a corresponding groove 72 provided in the external face of said support flange 24.

Said plug for blocking rotation of said braking shoes slides freely in the groove 72 in a radial direction and does not cause therefore any impediment to the free expansion in a radial direction of said braking shoes.

A further advantage of the braking assembly for reel-holder flanges of the present invention is therefore represented by the fact that it occupies a small volume, especially as regards the transverse extension of the braking assembly. In fact, in it the said elastic return means are housed in splines formed inside the body of said braking shoes and the latter braking shoes have been provided with an enlarged section only at the internal annular portion where said compression chambers are provided for the thrust piston with an annular portion more external radially which has small transverse dimensions. This provides, with a further advantage, a configuration of the reel-holder flange with a withdrawn external annular portion 74 to define a support surface of the edge of said cop 12. Moreover with the braking assembly of the present invention, the thrust devices are housed inside the braking shoes and not outside as was the case with previous methods, allowing an advantageously thin transverse width of the assembly to be obtained.

Additionally, the braking assembly of the present invention can easily be assembled in a small space of time. In fact the braking assembly does not have elements which have to be screwed or jointed one to the other, and it is sufficient in order to assemble them for the various component parts to be arranged in their predefined position.

The braking device of the present invention is also driven by means of a pressurised fluid which can easily be taken from a drive circuit of the usual operative parts of the textile machine, and can therefore also be installed easily on machines already in use without requiring specific and awkward machining operations.

It is clear that what has been written and shown in the accompanying drawings with reference to the preferred embodiment of the present invention has been given purely by way of a non-limiting example of the principle claimed.

What is claimed is:

1. Braking assembly for a reel-holder flange in textile apparatus, comprising a fixed flange having an annular braking band connected to an arm for supporting a reel, at least a first and a second arcuate braking shoes supported by said fixed flange, in which each of said braking shoes has a lateral end face with the lateral end faces of one of said braking shoes parallel and opposite to the end faces of the other braking shoe, and a respective external arcuate lateral face which defines a braking surface, the braking assembly also comprising means for blocking rotation of said first and second braking shoes in relation to said fixed flange, means for driving said first and second shoes towards and against said annular braking band to engage it with friction and to brake rotation of said reel-holder flange, elastic return means comprising a continuous elastic element which winds around said braking shoes and acts in a radial direction to bring them close one to the other and return them to a rest condition, said means for driving the shoes comprising at least a first and a second thrust device provided between said first and second braking shoes at the facing and opposite end faces of said braking shoes, said thrust devices acting on said braking shoes in a circumferential direction to the latter in order to move them apart one from the other towards and against said coupling band of said reel-holder flange.

2. Braking assembly for a reel-holder flange according to claim 1, in which said first thrust device is arranged between one lateral end face of said first braking shoe and the opposite lateral end face of said second braking shoe and said second thrust device is arranged between the other lateral end face of said first braking shoe and the corresponding opposite lateral end face of the second braking shoe.

3. Braking assembly for a reel-holder flange according to claim 1, in which said first and second thrust devices are actuated by a pressurised fluid.

4. Braking assembly for a reel-holder flange according to claim 3, in which each of said thrust devices comprises a respective thrust piston housed and sliding in a respective cylindrical chamber provided inside at least one of said braking shoes, the lateral end of the latter, said thrust pistons being housed in said cylindrical chambers and projecting outside of the latter towards and in contact with the opposite lateral end faces of the other braking shoe and in which said thrust pistons are driven with a thrusting action by a pressurised fluid inside of the respective compression chamber rear to the pistons.

5. Braking assembly for a reel-holder flange according to claim 4, in which each of said compression chambers is fed by the pressurised fluid by means of a feed pipe which extends outside of the respective shoe on the rear side of the latter.

6. Braking assembly for a reel-holder flange according to claim 4, in which, each of said compression chambers for the respective thrust device is formed on a different braking shoes respectively.

7. Braking assembly according to claim 4, in which said compression chambers are formed in internal annular portions of the relative shoe, and in which at said internal annular portions for housing said compression chambers each shoe has an enlarged radial section.

8. Braking assembly for a reel-holder flange according to claim 7, in which said reel-holder flange has an annular recess provided at the radially external portion of smaller thickness of said braking shoes, said annular recess defining an annular surface of support for the reel.

9. Braking assembly for a reel-holder flange according to claim 4, in which said thrust pistons are in the form of a cylindrical body having a length greater than that of the respective compression chambers for providing in the rest condition a support and spacing element between the opposite lateral end faces of said braking shoes.

10. Braking assembly for a reel-holder flange according to claim 1, in which said means for blocking rotation of said braking shoes comprise at least one plug which extends radially from the internal surface of at least one of said braking shoes and is inserted, freely sliding, in a radial direction in a corresponding groove formed in said fixed support flange.

11. Braking assembly for a reel-holder flange according to claim 1, in which each of said braking shoes has a respective arched spline for housing said continuous elastic return element, and in which said arched splines are provided at the rear face of each shoe in an external radial position in relation to said pressure chambers.

* * * * *